US007793525B2

(12) United States Patent
Kopyrin et al.

(10) Patent No.: US 7,793,525 B2
(45) Date of Patent: Sep. 14, 2010

(54) WASHING MACHINE AGITATOR ASSEMBLY

(75) Inventors: Viktor N. Kopyrin, Dearborn, MI (US); Robert J. Pinkowski, Baroda, MI (US); James J. Visin, Benton Harbor, MI (US); Raveendran Vaidhyanathan, St. Joseph, MI (US); Mary E. Zeitler, St. Joseph, MI (US); Dale E. Mueller, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 896 days.

(21) Appl. No.: 11/133,809

(22) Filed: May 20, 2005

(65) Prior Publication Data

US 2005/0284196 A1 Dec. 29, 2005

Related U.S. Application Data

(60) Provisional application No. 60/521,746, filed on Jun. 29, 2004.

(51) Int. Cl.
*D06F 13/00* (2006.01)

(52) U.S. Cl. ..... 68/133; 68/134

(58) Field of Classification Search ..... 68/133, 68/134

See application file for complete search history.

(56) References Cited

U.S. PATENT DOCUMENTS

| | | | | | |
|---|---|---|---|---|---|
| 1,754,626 | A | | 4/1930 | Holzhausen | |
| RE18,928 | E | * | 8/1933 | Unruh et al. | 68/133 |
| 2,726,529 | A | * | 12/1955 | Clark | 68/133 |
| 3,112,632 | A | | 12/1963 | Walton | |
| 3,307,383 | A | | 3/1967 | Cobb et al. | |
| 3,381,504 | A | | 5/1968 | Smith | |
| 3,608,110 | A | | 9/1971 | Hubbard et al. | |
| 3,736,775 | A | * | 6/1973 | Smith | 68/23 R |
| 4,018,067 | A | | 4/1977 | Vona, Jr. et al. | 68/134 |
| 4,068,503 | A | | 1/1978 | Platt | 68/133 |
| 4,193,275 | A | * | 3/1980 | Bochan | 68/134 |
| 4,555,919 | A | | 12/1985 | Brenner et al. | 68/134 |
| 4,779,431 | A | | 10/1988 | Burk et al. | 68/12 |
| 5,784,902 | A | | 7/1998 | Pinkowski | 68/12.02 |
| 5,839,300 | A | * | 11/1998 | Yoon et al. | 68/134 |
| 6,212,722 | B1 | * | 4/2001 | Pinkowski et al. | 68/134 |
| 6,227,014 | B1 | | 5/2001 | Euler et al. | 68/134 |

* cited by examiner

*Primary Examiner*—Michael Cleveland
*Assistant Examiner*—Samuel A Waldbaum
(74) *Attorney, Agent, or Firm*—Clifton G. Green; McGarry Bair PC

(57) ABSTRACT

A clothes mover in a washing machine comprises a body mounted for reciprocal rotational movement about a generally vertical axis and at least one vane, which comprises a base mounted to the body and a tail extending from the base and having an upper edge that transitions into a tip. The tail can be free of the body for side-to-side flexing and can be configured such that a portion of the tail extending between the upper edge and the tip can flex from a generally vertical position toward the body. The body can be made of a first material, and the vane can be made of a second material different from the first material.

38 Claims, 17 Drawing Sheets

WASHING MACHINE AGITATOR ASSEMBLY

CROSS-REFERENCE TO RELATED APPLICATION

This application claims the benefit of U.S. Patent Application No. 60/521,746, filed Jun. 29, 2004.

BACKGROUND OF THE INVENTION

1. Field of the Invention

The invention relates generally to an agitator assembly for a washing machine and more particularly to an agitator assembly comprising an agitator with vanes that can flex in multiple directions.

2. Description of the Related Art

Automatic washing machines are widely known and commonly used to wash a load of clothes comprising one or more clothing articles in accordance with a programmed wash cycle. Clothes washers of this type typically comprise a perforated basket located within an imperforate tub, with the basket being rotatable relative to the tub. The clothing is placed in the basket where the wash liquid is free to flow between the basket and the tub through the perforations. Vertical axis immersion-type washing machines typically comprise a single- or dual-action agitator assembly within the basket, and the agitator assembly rotates relative to the basket about a vertical axis to impart mechanical energy to the submerged clothing. Single-action agitator assemblies comprise a reciprocating agitator having an agitator barrel and a skirt portion with circumferentially spaced vanes. The agitator vanes extend radially outward from the agitator barrel, and the lower edge thereof can be completely integral with the skirt or spaced from the skirt. The agitator vanes, along with the agitator barrel and the skirt, are typically injection molded polypropylene. Consequently, the vanes are relatively stiff and are substantially inflexible when they are integral with the skirt or flex only about an axis parallel with the vertical axis when the lower edge is spaced from the skirt.

Dual-action agitators incorporate an auger for driving the clothes down to the agitator. A traditional auger surrounds the agitator barrel and is coupled to the agitator by a unidirectional clutch. The auger typically comprises a tubular body and a continuous helical vane having a constant cross section. The helical vane is integral with and extends outwardly from the body and comprises a root portion where it meets the body and tapers outward to a tip. The helical vane can be perpendicular to the central axis of the body or, more preferably for better wash performance, undercut or inclined relative to the central axis, as shown in the above mentioned Pinkowski patent. Augers are preferably produced with an injection molding process. To accommodate the undercut of the helical vane, the injection molding process uses multiple radially-moveable mold sections surrounding a core, wherein after the material is injected into the core and sufficiently solidified, the molds are retracted radially while the core is simultaneously axially pulled from the molds.

The combination of the method of making the auger and the physical characteristics (continuous spiral, undercut vane, and constant radial cross section) creates a limit on the radial extent or width (the radial distance from the tubular body to the tip) of the helical vane and causes the helical vane to have a relatively thick root. The actual width of the vane is limited to a value less than the maximum vane width, which is the largest possible width for the vane. The thickness of the vane at the root and the maximum vane width depends on the degree of vane taper, which also referred to as the draft angle, from the root to the tip. The draft angle is a function of the undercut angle, which is the angle between the lower surface of the vane and the outer wall of the body, and the vane pitch, which is the distance between adjacent turns of the vane and is indicative of the slope of the vane. Assuming all other variables are constant, a larger undercut angle and a smaller pitch each individually corresponds to a smaller draft angle and, thus, a thinner root and a larger maximum vane width. However, the combination of a desired undercut angle and pitch to achieve a desired auger performance in prior art auger designs results in a relatively large draft angle and, thus, a thick root and a shorter width. As an example, some prior art auger vanes have a root that are on the order of 12-16 mm and a maximum vane width of about 33-35 mm. Corresponding ratios of vane width to root thickness for these values range from about 2.2-2.8, which means that the vane width is less than about 3 times the root thickness.

Unfortunately, a thick root can lead to several problems associated with the injection molding process and with the auger itself. For example, not only do such vanes require a large volume of material, but also the root must sufficiently solidify before the auger can be removed from the molds. As a result, the cycle times can be undesirably long, and the life of the mold is relatively short. Additionally, when the root is thick, the cylindrical body warps into an oblong, egg-like shape, and a depression or sink forms on the inside wall of the body at the vane because the root of the vane tends to pull the body outward while cooling. Because the auger fits over and rotates relative to the agitator barrel, the auger must be adapted to accommodate for warpage and sinks so that it is concentric with the agitator barrel.

To avoid the problems associated with thick roots, the undercut angle can be increased, and the pitch can be decreased to thereby decrease the root thickness. Such a solution would also increase the maximum vane width, which can increase the effectiveness of the auger. However, the undercut angle and the pitch are selected based at least partly upon the washing performance and efficiency of the washing machine, and it is undesirable to change the undercut angle and the pitch to the extent needed to achieve a large maximum vane width and a relatively thin root.

During use of the washing machine, the auger vane imparts a downward motion to the clothing articles and the wash liquid, and the agitator vanes impart a centrifugal motion to the clothing articles and the wash liquid. Hence, as the auger rotates in one direction and the agitator rotates reciprocally, the auger pushes the clothing articles from the surface of the wash liquid down towards the agitator, and the agitator pushes the clothing articles outward toward the basket. As the clothing articles approach the inner wall of the basket, the basket functions as a barrier to further centrifugal outward movement, and centrifugal pressure from the moving wash liquid and from other clothing articles is converted to higher static pressure. Increased static pressure pushes the wash liquid and clothing articles, and some wash liquid and clothing articles move downward while the majority moves upward along the basket towards the surface of the wash liquid where they are pushed downward again by the auger. As a result, the clothing articles are washed as they move along a toroidal path, and one full cycle along this path is commonly referred to as a rollover.

Because the agitator relies on the interactions between the wash liquid, the clothing articles, and the basket to move the clothing articles upward, the agitator has to impart a large amount of mechanical energy to the clothing articles to maintain the movement thereof along the toroidal path and to achieve a desired number of rollovers. Friction losses during flow transmission from the outward movement to the upward movement require additional energy to transform flow from outward direction to upward direction. A motor drives reciprocal rotation of the agitator, and the rotational energy of the agitator is converted to the mechanical energy applied to the clothing articles. Larger mechanical energy requirements, therefore, can strain the motor and result in high electrical energy consumption. Additionally, clothing articles can collect at the bottom of the basket and impede movement of the clothes load along the toroidal path, which can lead to reduced washing performance and effectiveness of the washing machine.

SUMMARY OF THE INVENTION

A washing machine according to one embodiment of the invention comprises a basket defining a wash chamber and a clothes mover mounted in the wash chamber. The clothes mover comprises a body mounted for reciprocal rotational movement about a generally vertical axis and at least one vane. The at least one vane comprises a base mounted to the body and a tail extending from the base and having an upper edge that transitions into a tip, the tail being free of the body for side-to-side flexing and configured such that a portion of the tail extending between the upper edge and the tip can flex from a generally vertical position toward the body.

The tail can further comprise a strengthening region having a thickness greater than the rest of the tail. The strengthening region can extend in a direction defined between the base and the tip. The thickness of the strengthening region can increases toward the base.

A height of the tail can increase from the base of the at least one vane to the tip of the tail.

The tip can extend radially beyond the body.

The body can comprise a depression that at least partially receives the tail and accommodates the side-to-side flexing of the tail.

The body can be made of a first material, and at least the tail of the at least one vane can be made of a second material different from the first material. The entire vane can be made of the second material. The second material can be more flexible than the first material. The second material can comprise an elastomer. The first material can comprise polypropylene. The at least one vane can be integrally molded with the body.

The clothes mover can be an agitator.

The clothes mover can comprise a plurality of the vanes. The plurality of the vanes can be equally spaced. The vanes can be oriented radially relative to the vertical axis.

A washing machine according to another embodiment of the invention comprises a basket defining a wash chamber and a clothes mover located in the wash chamber. The clothes mover comprises a body made of a first material and at least one vane mounted to the body made of a second material different from the first material.

A flexural modulus of the second material can be greater than a flexural modulus of the first material. The second material can comprise an elastomer. The first material can comprise polypropylene.

The at least one vane can be integrally molded with body.

The at least one vane can extend radially beyond the body.

The at least one vane can comprise a base and a tail that is free of the body for flexing in a first direction. The first direction can be side-to-side. The at least one vane can be configured to flex in a second direction different from the first direction.

The clothes mover can be an agitator.

The clothes mover can comprise a plurality of the vanes. The plurality of the vanes can be equally spaced. The vanes can be oriented radially relative to the vertical axis.

DESCRIPTION OF THE PREFERRED EMBODIMENT

Figure 1:
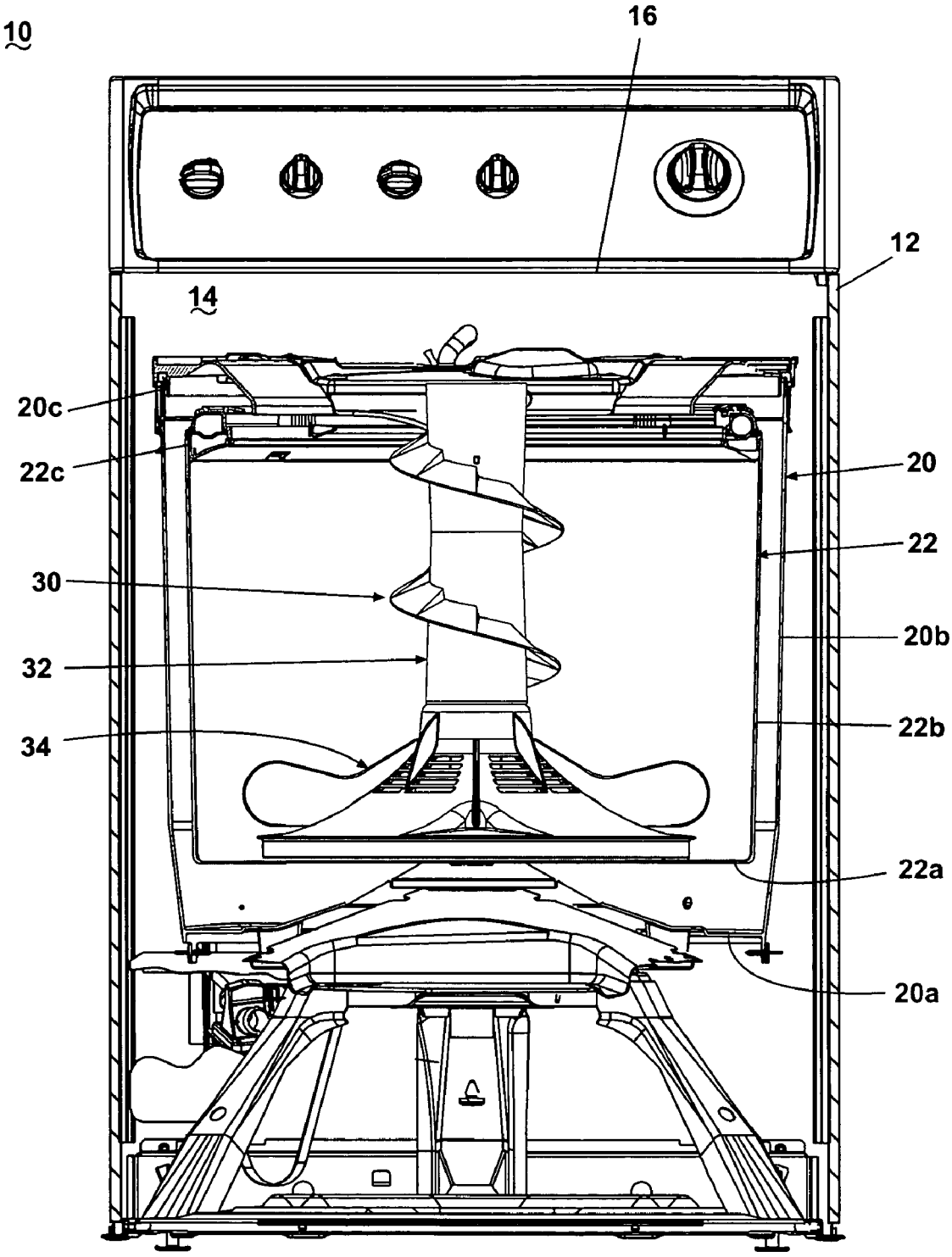
FIG. 1 is a partial sectional view of a washing machine with an agitator assembly according to one embodiment of the invention comprising an auger and agitator.

Referring now to the drawings and particular to FIG. 1, there is shown a washing machine 10 providing an illustrative environment for the invention. As illustrated, the washing machine 10 is a vertical axis clothes washer comprising an exterior cabinet 12 defining an interior 14 accessible through an opening 16 in the top of the cabinet 12, which is normally closed by a door (not shown) hingedly mounted to the cabinet 12. An imperforate tub 20 and a perforated basket 22 are located within the interior 14 of the cabinet 12. The tub 20 and the basket 22 are mounted in the cabinet 12 in a traditional manner such that the basket 22 can rotate relative to the tub 20.

Each of the tub 20 and basket 22 comprises a closed bottom 20*a*, 22*a* and a peripheral wall 20*b*, 22*b* extending upwardly from the corresponding bottom 20*a*, 22*a* and terminating in an upper edge 20*c*, 22*c*, which defines an open top. The peripheral walls 20*b* and 22*b* are preferably cylindrical resulting in the open top having a circular shape.

A wash liquid system (not shown) is commonly used to introduce wash liquid onto clothing placed in the basket 22. The wash liquid can comprise water or a mixture of water with wash aid, such as detergent. The wash liquid system normally comprises a wash aid dispenser and a water inlet along with a pump coupled to the tub for draining or recirculating the wash liquid from the tub. The type of wash system is not germane to the invention. There are many well-known wash systems. One common type of wash system is the immersion type, which at least partially fills the basket 22 and tub 20 with wash liquid to clean the clothes while they are immersed in the wash liquid. Another common wash system is a reciprocating wash liquid system that reciprocates wash liquid through the clothing. Some systems are capable of both immersion and reciprocation, with the selection of a particular method being dependent on a particular wash cycle.

An agitator assembly 30 according to one embodiment of the invention is mounted within the basket 22 and rotates relative to the basket 22 to aid in cleaning the clothing. The agitator assembly 30 comprises an auger 32 and an agitator 34, which can rotate relative to one another about a common, vertical axis. The auger 32 couples with the agitator 34 through a drive mechanism, such as a unidirectional clutch (not shown). Rotation of the auger 32 moves the clothing downwardly from the surface of the wash liquid and towards the agitator 34. A motorized drive mechanism reciprocally rotates the agitator 34 clockwise and counterclockwise about the common axis such that the agitator 34 oscillates and simultaneously moves the clothing outward towards the basket 22 and upward towards the surface of the wash liquid where it is pushed downward again by the auger 32. Hence, the agitator assembly 30 moves the clothing along a toroidal path defined between the agitator assembly 30 and the basket 22. One full cycle along the toroidal path is commonly referred to as a rollover.

Figure 2:
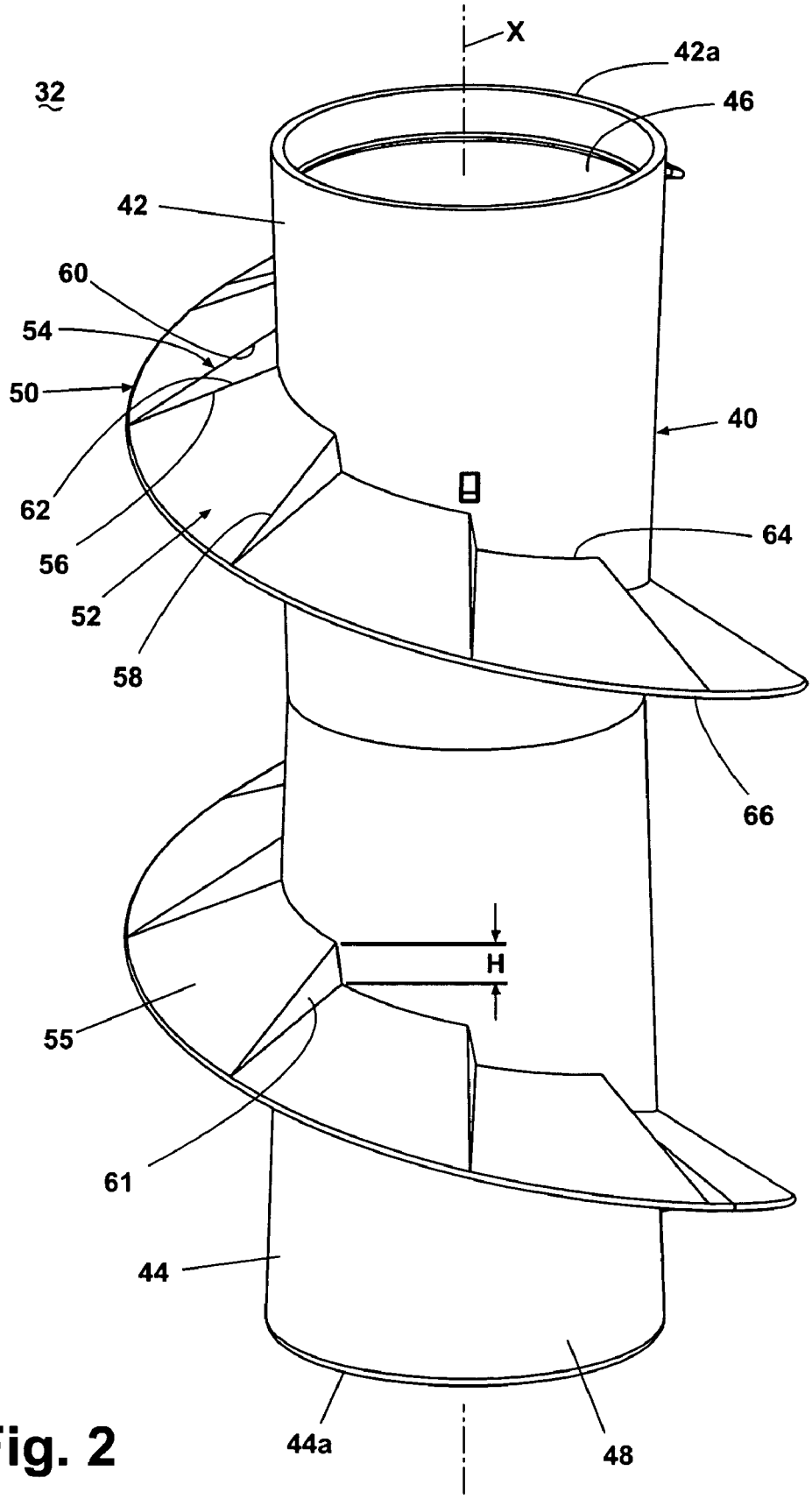
FIG. 2 is an upper perspective view of an auger of the agitator assembly shown in FIG. 1 according to one embodiment of the invention.
Figure 3:
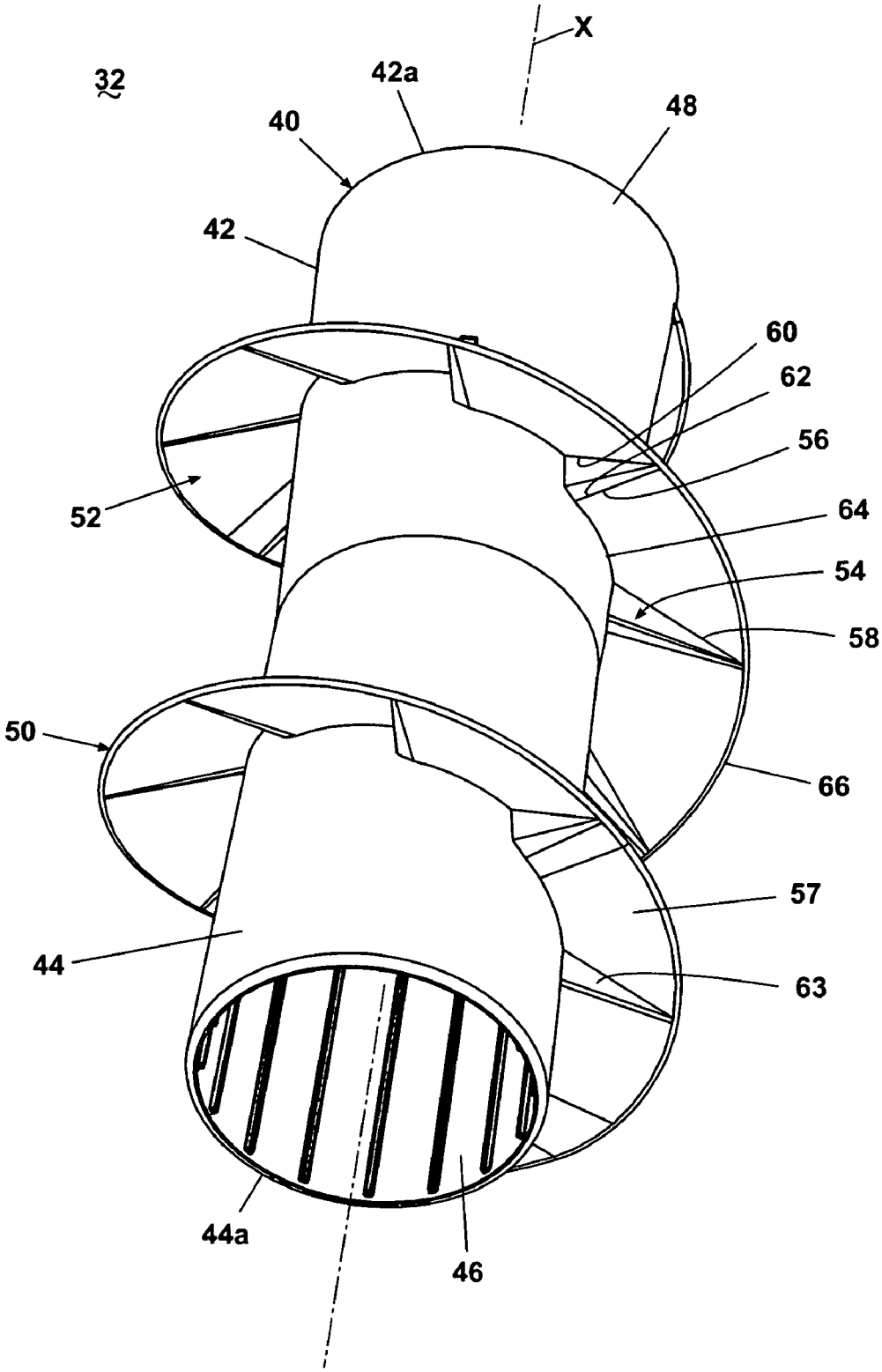
FIG. 3 is a lower perspective view of the auger shown in FIG. 2.

Both the auger 32 and agitator 34 will be described in further detail. FIGS. 2-7 illustrate the details of the auger 32 according to one embodiment of the invention. Referring particularly to FIGS. 2 and 3, the auger 32 comprises a tubular body 40 and a continuous auger vane 50 that spirals around the tubular body 40. The tubular body 40 comprises an inner surface 46, an outer peripheral surface 48, an upper portion 42 having an upper end 42*a*, a lower portion 44 having a lower end 44*a*, and a central longitudinal axis X. According to one embodiment, the tubular body 40 has a circular cross-section taken generally perpendicular to the central longitudinal axis X. The lower portion 44 is sized to receive a portion of the agitator 34 and preferably tapers toward the upper portion 42, and, similarly, the upper portion 42 preferably tapers toward the lower portion 44. Alternatively, the upper and lower portions 42, 44 can have can have a constant diameter or they can taper away from each other. Regardless of the relative sizes of the upper and lower portions 42, 44 and the regions therebetween, the body 40 maintains a circular cross-section from the upper end 42*a* to the lower end 44*a*.

While the auger vane 50 can have any suitable length, the auger vane 50 in the illustrated embodiment spirals from near the upper end 42*a* of the body 40 to near the lower end 44*a* of the body 40. The auger vane 50 is formed by multiple ledges 52, wherein adjacent ledges 52 are joined by a step 54. Each ledge 52 is bounded by a trailing first end 56 and a leading second end 58, and, similarly, each step 54 is bounded by a trailing first end 60 and a leading second end 62. The ledges 52 and steps 54 are arranged such that the first ends 60 of the steps 54 coincide with the second ends 58 of the ledges 52, and the second ends 62 of the steps 54 coincide with the first ends 56 of the ledges 52. In other words, one step 54 connects the second end 58 of one ledge 52 with the first end 56 of an adjacent ledge 52. Further, each ledge 52 has an upper surface 55 and a lower surface 57, and each step 54 has an upper surface 61 and a lower surface 63.

Figure 4:
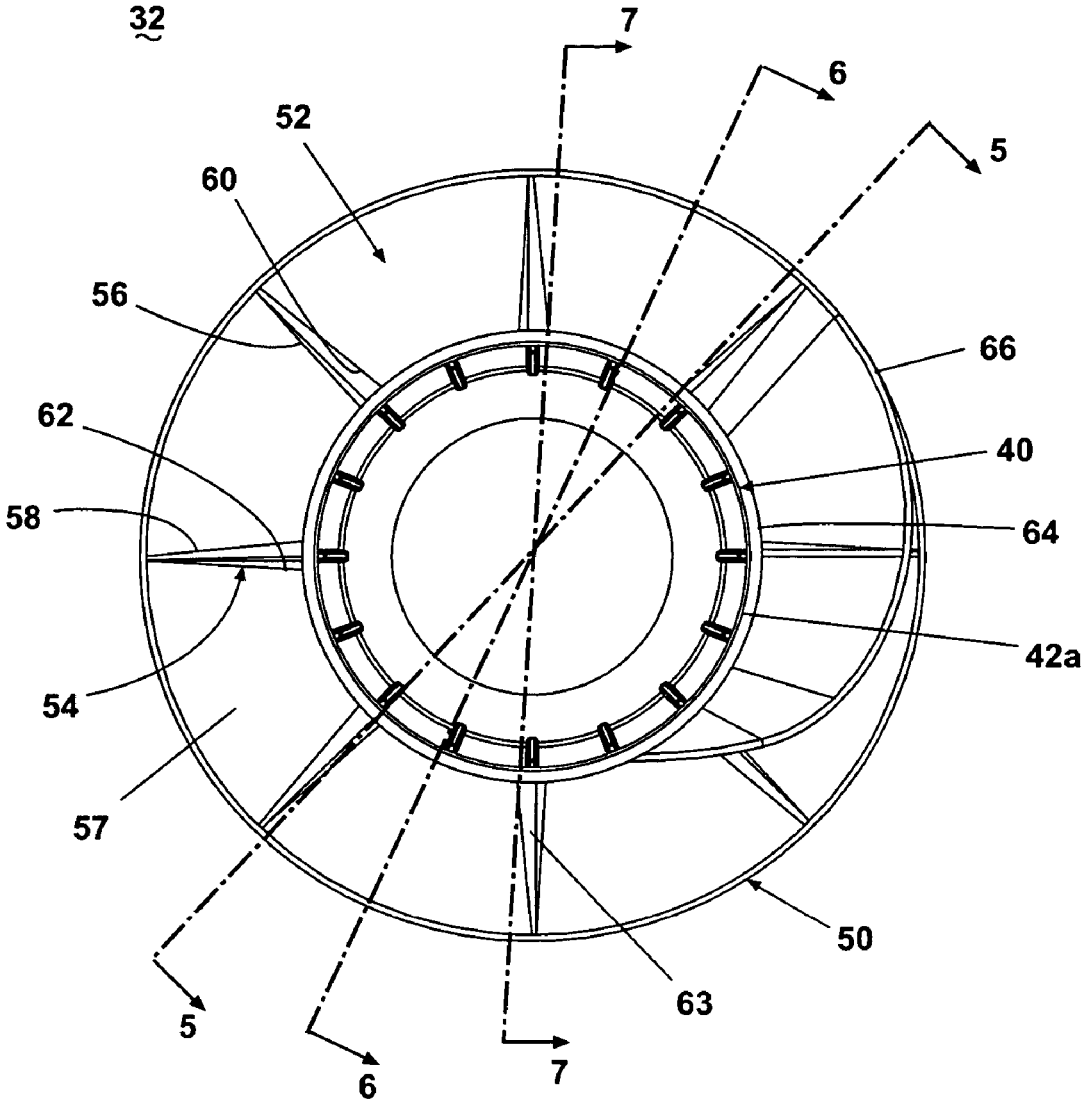
FIG. 4 is a bottom view of the auger shown in FIG. 2.
Figure 5:
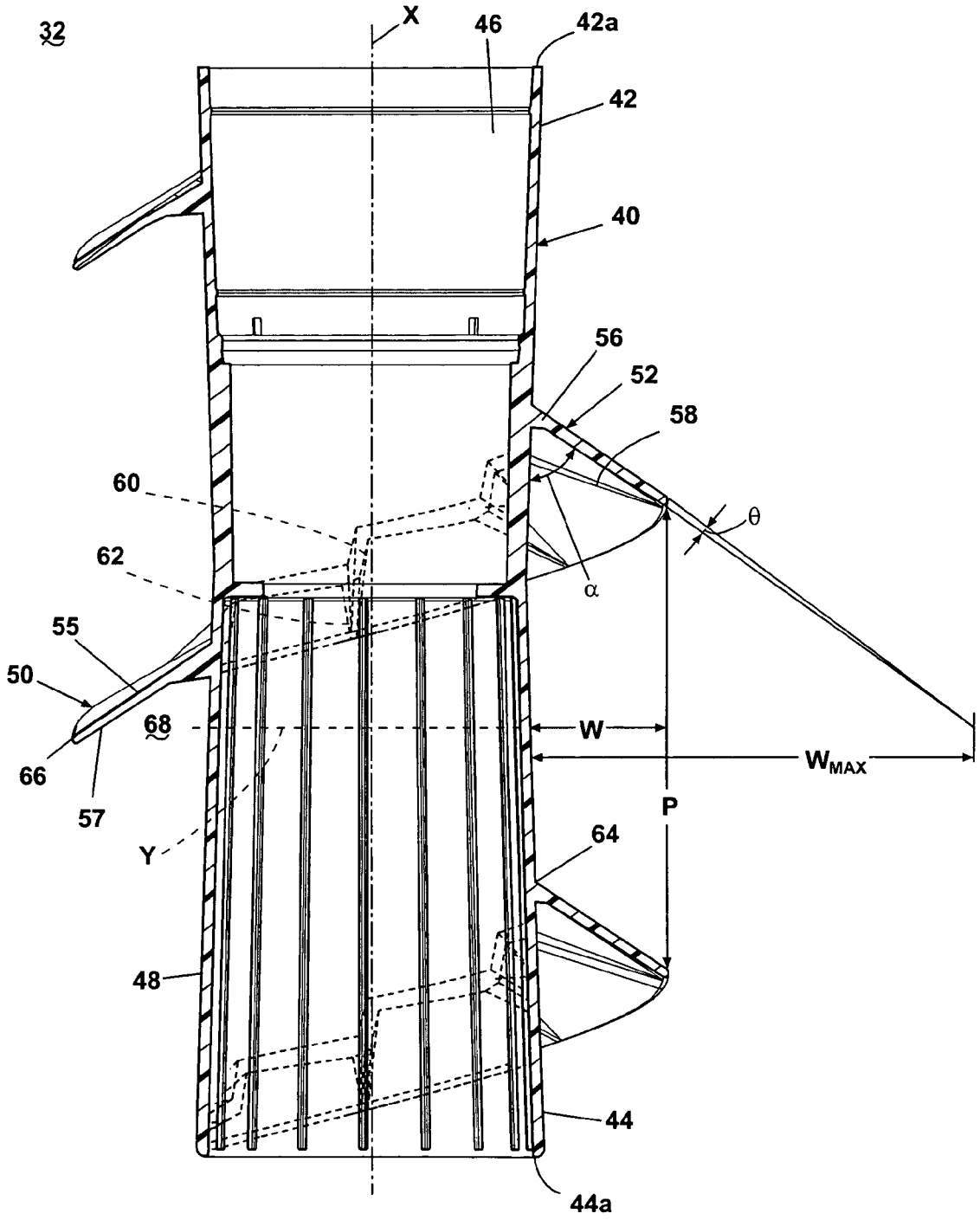
FIG. 5 is a sectional view taken along line 5-5 of FIG. 4.
Figure 6:
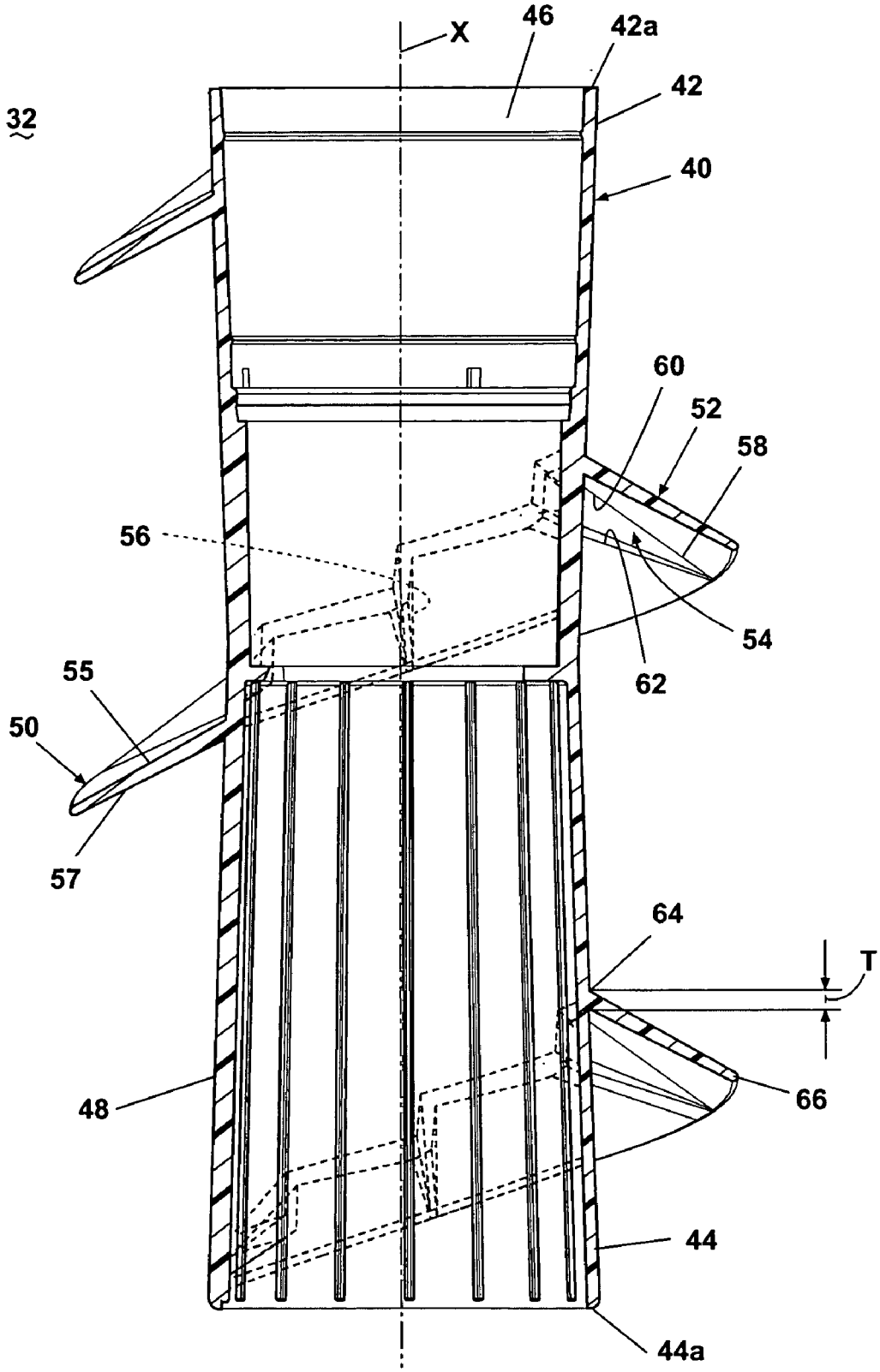
FIG. 6 is a sectional view taken along line 6-6 of FIG. 4.
Figure 7:
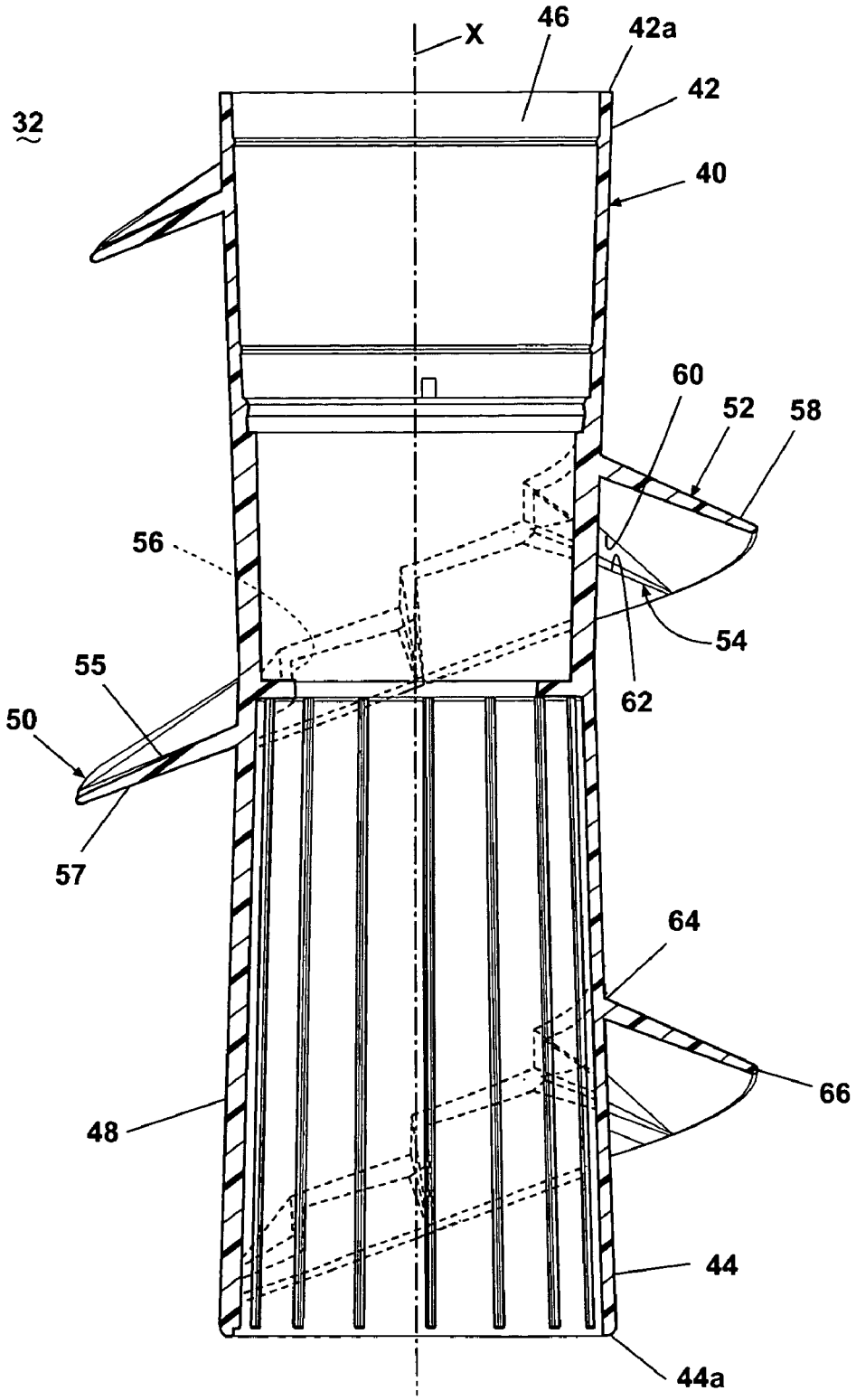
FIG. 7 is a sectional view taken along line 7-7 of FIG. 4.

The ledges 52 are attached to the body 40 at a root 64 and extend outwardly to a tip 66. According to the illustrated embodiment of the invention, the tip 66 forms a helix around the tubular body 40. The ledges 52 taper slightly from the root 64 to the tip 66, and, as seen in FIGS. 5-7, which are sectional views taken along lines indicated in FIG. 4, the degree of taper is constant from the first to the second edges 56, 58 of each ledge 52. The degree of taper, which can be quantified as a draft angle θ measured between the upper and lower surfaces 55, 57 of the ledge 52, determines a thickness T of the root 64 and a maximum vane width $W_{max}$, as particularly illustrated in FIGS. 5 and 6. The root thickness T is the distance between the upper and lower surfaces 55, 57, as shown in FIG. 6. Because a thin root 64 (i.e., small thickness T) with a large maximum vane width $W_{max}$ is desired, for reasons provided in the background of the invention, the draft angle θ is preferably small. Because of the small draft angle θ, the auger vane width W, which is the radial distance from the peripheral surface 48 of the body 40 to the tip 66 along a line Y generally perpendicular to the central longitudinal axis X, as shown in FIG. 5, can be selected based on desired performance rather than the maximum vane width $W_{max}$ dictating the auger vane width W, as is the case for prior art auger vanes. For example, the draft angle θ can be less than about 12°. According to one embodiment of the invention, the draft angle θ is approximately 1°. With a relatively small draft angle θ, the vane width W and the root thickness T can be selected so that their ratio W/T is greater than that of prior art auger vanes. A large W/T corresponds to a large auger vane width W and a small root thickness T. For example, the ratio W/T can be greater than 4. According to one embodiment of the invention, the ratio W/T is between 13 and 14. Exemplary values of root thickness T and auger vane width W are 3 mm and 40 mm, respectively. The ratio W/T for these exemplary W and T values is 13.3. Furthermore, when the draft angle θ is approximately 1°, the taper is so slight that the maximum vane width $W_{max}$ can be increased by essentially shifting the auger vane 50 radially outward with only a slight increase in the root thickness T.

The ledges 52 are preferably undercut and oriented at an angle α relative to the body 40 to provide a recess 68 between the tip 66 and the outer surface 44 of the body 40. The undercut angle α, which is measured between the peripheral surface 48 of the body 40 and the lower surface 57 of the ledge 52, can gradually increase from the first end 56 of the ledge 52 to the second end 58 of the ledge 52. FIGS. 5-7 effectively illustrate the gradual increase in the undercut angle α. FIG. 5 is a sectional view taken along a line near the first end 56 of the ledge 52, FIG. 6 is a sectional view taken about midway between the first and second ends 56, 58, and FIG. 7 is a sectional view taken near the second end 58 of the ledge 52. The undercut angle α in FIG. 6 is slightly greater than that in FIG. 5, and the undercut angle α in FIG. 7 is slightly greater than in FIG. 6. For example, the undercut angle α can range from about 30 to about 85°. A more narrow exemplary range for the undercut angle α is from about 50° to about 75°. However, any suitable undercut angle α equal to or less than 90° can be utilized to optimize the performance of the auger 32. As the auger vane 50 engages the clothing during the operation of the washing machine 10, the undercut orientation of the ledges 52 retards the clothing from moving outwardly relative to the auger vane 50 and enhances engagement between the clothing and the auger vane 50 such that the auger vane 50 moves the clothing downwardly as the auger 32 rotates. Furthermore, as the auger vane 50 pushes the clothing downwardly, the steps 54 function as scrubbing surfaces that rub against the clothing to improve the cleaning performance of the washing machine 10, and the undercut angle α influences the intensity of the interaction between the steps 54 and the clothing. However, the clothing primarily interacts with the tip 66 of the auger vane 50, and, thus, the ability of the auger vane 50 to move the clothing through the toroidal path can be optimized by selecting a desired auger vane width W in combination with a desired undercut angle α.

Referring again to FIGS. 2-4, the ends 56, 58 of the adjacent ledges 52 are circumferentially spaced at the root 64 and converge at the tip 66; therefore, the steps 54 are generally triangular. Additionally, the steps 54 are slanted or inclined relative to the central longitudinal axis X of the body 40. Alternatively, the ledges 52 can be vertically aligned such that the steps 54 are vertical and parallel to the central longitudinal axis X of the body 40. Each step 54 has a height H, which is measured as the vertical distance between the first and second ends 60, 62 at the root 64, as shown in FIG. 2. While the step height H can be any suitable distance, exemplary values for the step height H are between about 3 mm and about 20 mm. According to one embodiment, the step height H is about 9 mm. Further, as best seen in FIG. 4, each turn of the auger vane 50 comprises 8 steps 54. However, each turn can have any suitable number of steps 54. An exemplary range for the number of steps in each turn is 4 to 20 steps.

To achieve a helical configuration, the auger vane 50 extends along the body 40 at a predetermined slope. The slope determines a pitch P, as shown in FIG. 5, which is the vertical spacing between tips 66 of adjacent turns of the auger vane 50 and vice-versa. The pitch P is a design parameter and is selected based upon desired performance. The pitch P should be large enough to fit a suitable volume of clothing between the adjacent turns of the auger vane 50, but the turns should be sufficiently close to retain the clothing therebetween. An exemplary range for the pitch P is from about 60 mm to about 200 mm. According to one embodiment of the invention, the pitch P is approximately 135 mm, but any suitable pitch P can be utilized to optimize the performance of the auger 32.

As discussed above, the performance of the auger 32 depends on several geometric characteristics of the auger vane 50. Specifically, the performance is a function of the undercut angle $\alpha$, the pitch P, and the auger vane width W. Further, it is preferred that the root 64 has a small thickness T to alleviate problems related to the shape of the body 40 and production of the auger 32. In prior art augers, wherein the auger vane lacks the steps 54, the desired undercut angle $\alpha$ and the desired pitch P necessarily correspond to a thick root 64 and a limited auger vane width W. However, because the auger vane 50 of the present invention includes the steps 54, the draft angle $\theta$ is not restricted by the undercut angle $\alpha$ or the pitch P. The steps 54 vertically space adjacent ledges 52 by a distance equal to the height H of the step 54, and, thus, the steps 54 enable the auger vane 50 to achieve the desired pitch P that corresponds to the predetermined slope with the individual ledges 52 having a slope less than the predetermined slope. Consequently, the draft angle $\theta$ of the ledges 52 and the resulting root thickness T and maximum vane width $W_{max}$ can be selected independent of the undercut angle $\alpha$ and the pitch P in order to improve rollover and cleaning performance and to avoid the aforementioned problems, such as warpage of the body 40 and sinks on the inner surface 46 of the body 24, commonly encountered when the root 64 is thick. The number of the steps 54 in one turn of the auger vane 50 and the height H of each step 54 can be adjusted to achieve the desired pitch P and the desired slope of each individual ledge 52.

Figure 8:
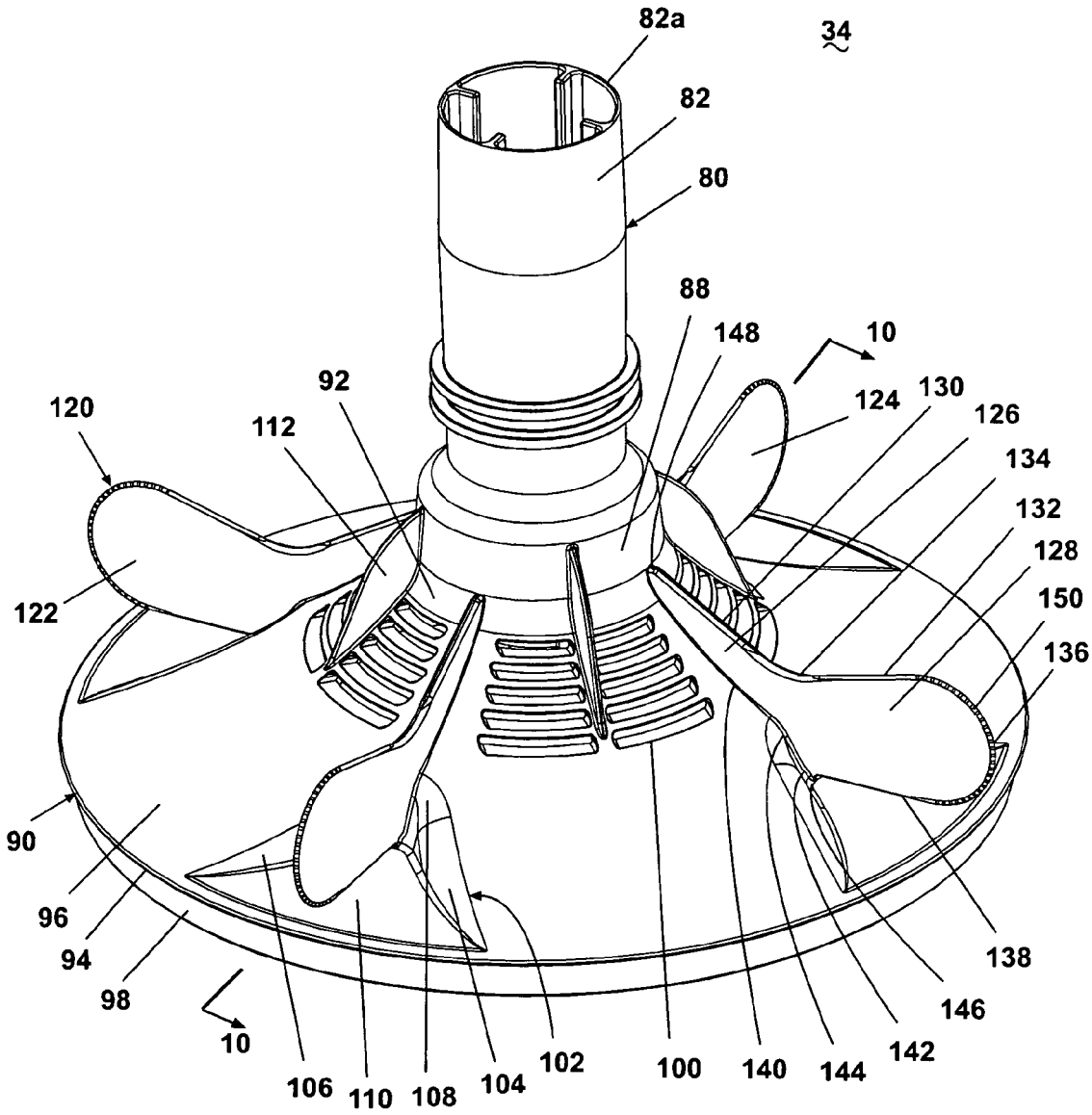
FIG. 8 is an upper perspective view of a first embodiment of an agitator from the agitator assembly shown in FIG. 1.
Figure 9:
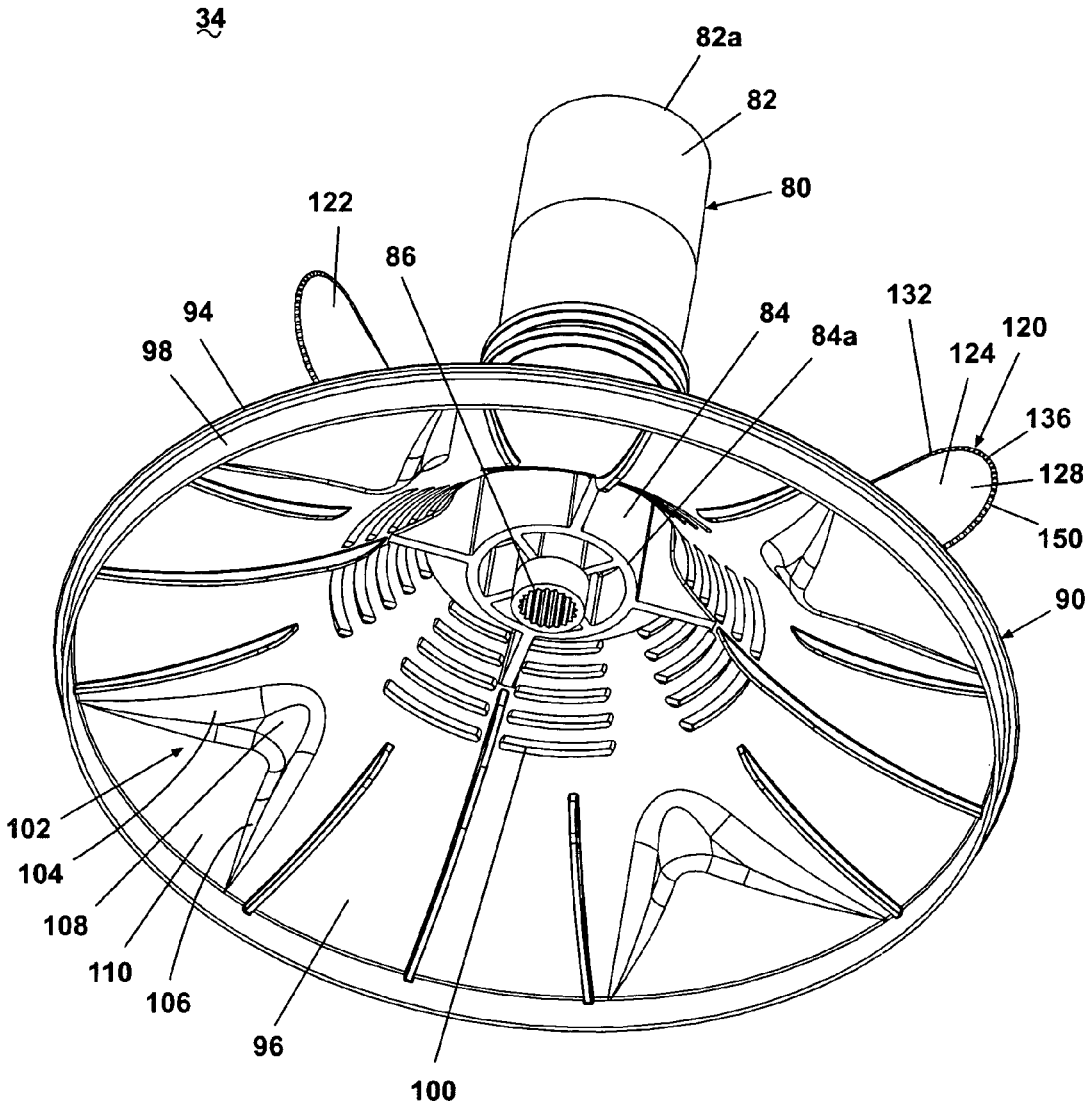
FIG. 9 is a lower perspective view of the agitator shown in FIG. 8.
Figure 10:
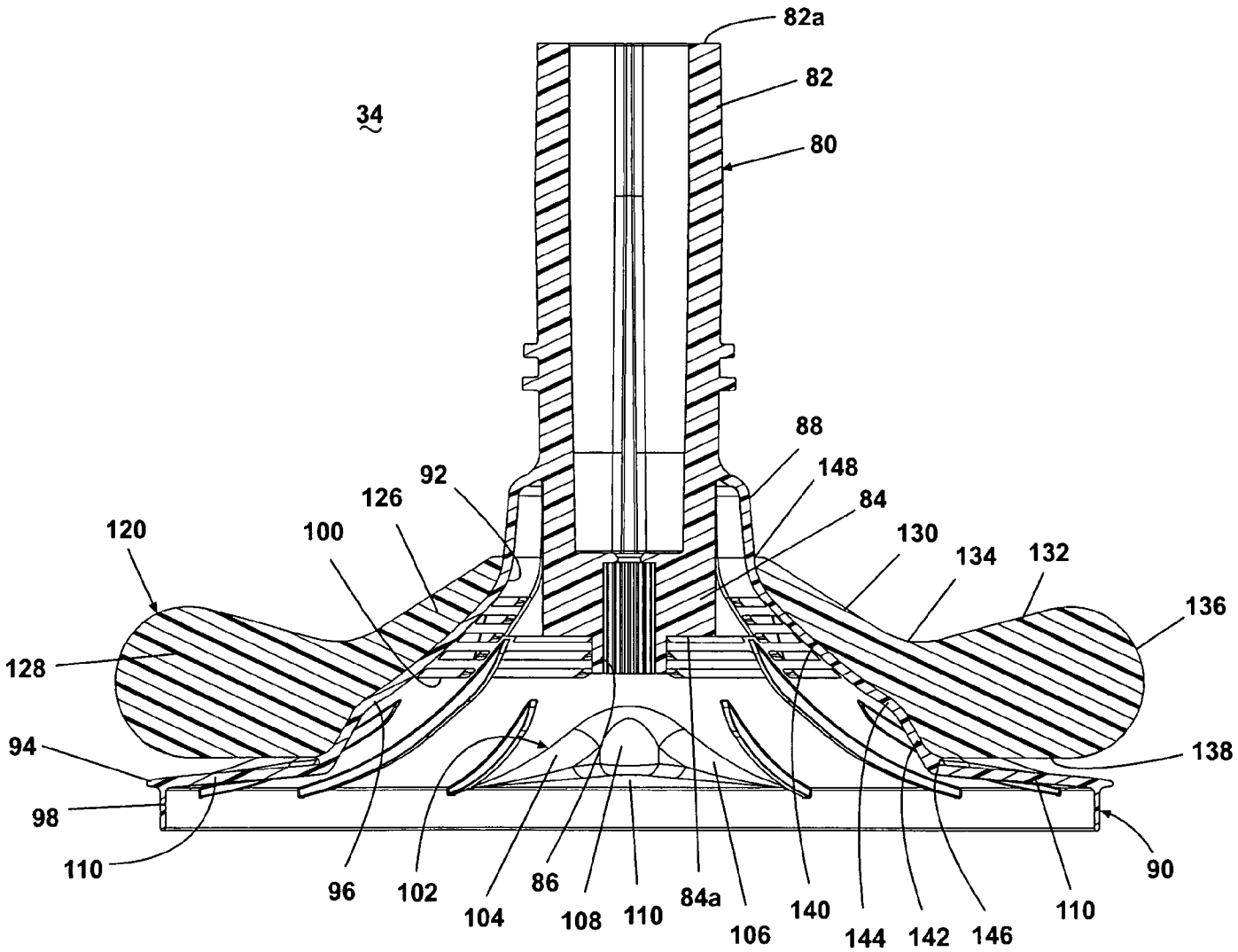
FIG. 10 is a sectional view taken along line 10-10 of FIG. 8.

Referring now to FIGS. 8-10, the agitator 34 comprises a vertical agitator barrel 80 integral with a substantially circular body or skirt portion 90. The agitator barrel 80 is substantially cylindrical and has an upper portion 82 with an upper end 82*a* and a lower portion 84 with a lower end 84*a*. As best seen in FIG. 9, the lower portion 84 extends beneath the skirt portion 90 and includes a drive connector 86 that couples with the motorized drive mechanism for reciprocally rotating the agitator 34. The agitator barrel 80 joins with the skirt portion 90 at an intermediate ring 88 having an outer diameter greater than that of the agitator barrel 80.

The skirt portion 90 comprises a skirt 96 that flares outward from a sloped inner perimeter ring 92 to a circular outer perimeter 94 having a depending flange 98. The skirt 96 includes multiple vents 100 near the inner perimeter ring 92 for filtering the wash liquid as it passes therethrough. The skirt 96 further comprises several circumferentially spaced depressions 102 near the outer perimeter 94. Each depression 102 is formed by a right wall 104 and an opposing left wall 106 that abut at a corner 108 and an inclined, substantially triangular bottom wall 110 that joins the right and left walls 104, 106 along their bottom edges.

To facilitate movement of the clothing along the toroidal path, the skirt portion 90 further comprises multiple fins 112 and agitator vanes 120. The fins 112 are circumferentially spaced and extend radially outward from the intermediate ring 88 to the skirt 96. Preferably, the fins 112 are relatively short and terminate at a location on the skirt 96 near the outermost vents 100; however, it is within the scope of the invention for the fins 112 to terminate ahead of or beyond the outermost vents 100.

Figure 11:
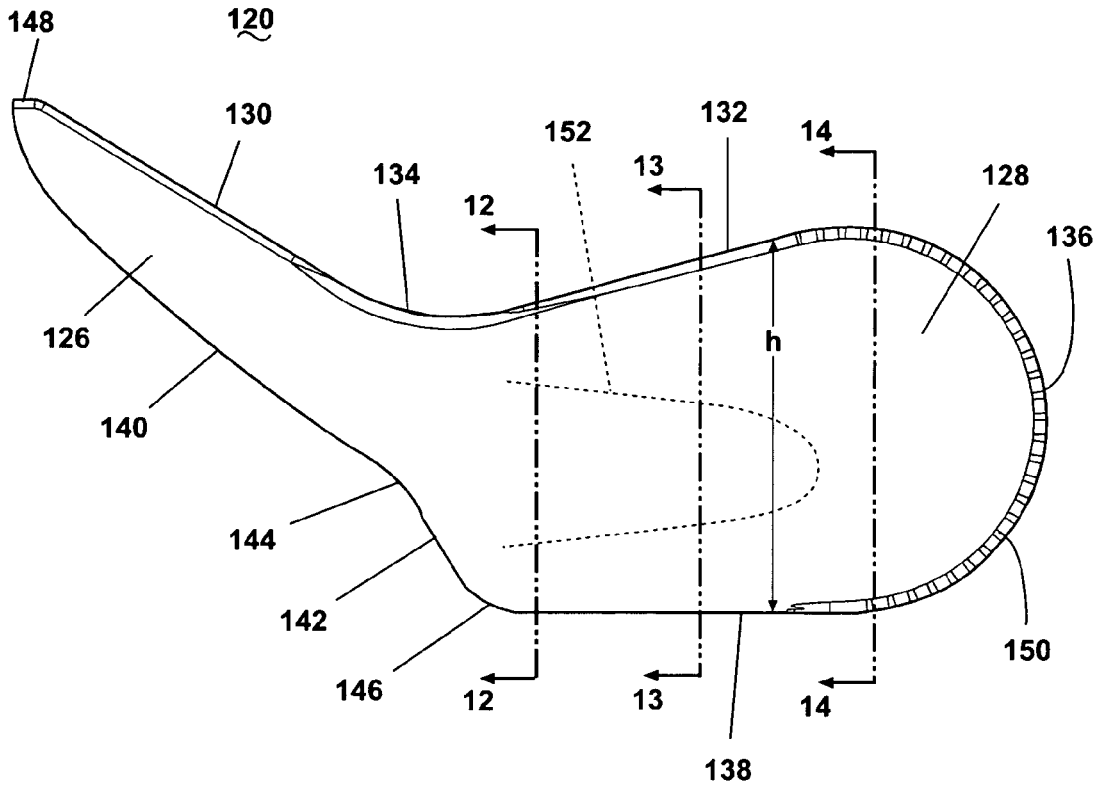
FIG. 11 is a side view of an agitator vane from the agitator shown in FIG. 8.

Referring additionally to FIGS. 11-14, the agitator vanes 120 are circumferentially spaced and extend radially outward from the inner perimeter ring 92 of the skirt portion 90, along the skirt 96, and through the depression 102. As best seen in FIG. 10, the agitator vanes 120 preferably extend beyond the outer perimeter 94 of the skirt portion 90. Each agitator vane 120 comprises a right face 122 in opposing relationship with right wall 104 of the depression 102 and a left face 124 that opposes the left wall 106 of the depression 102. As best seen in FIG. 11, the agitator vane 120 further comprises an elongated base 126 and a tail 128, which are defined by an upper edge having a first portion 130 and a second portion 132 joined at a corner 134, a substantially horizontal bottom edge 138, an arcuate outer edge or tip 136 that connects the upper edge second portion 132 to the bottom edge 138, and a rear edge having a first portion 140 connected to the upper edge first portion 132 at an upper connection point 148 and a second portion 142 joined to the first portion 140 at a corner 144 and to the bottom edge 138 at a lower connection point 146. The base 126 is the area bounded by the upper edge first portion 130 and the upper edge corner 134 and the rear edge first portion 140 and the rear edge corner 144, while the tail 128 comprises the area bounded by the upper edge second portion 132, the tip 136, the bottom wall 138, and the rear edge second portion 142. Because the bottom edge 138 is substantially horizontal and the upper edge second portion 132 slopes upward from the upper edge corner 134 to the tip 136, a height h of the agitator vane, which, as shown in FIG. 11, is defined by the distance between the bottom edge 138 and the upper edge second portion 132, increases from the base 126 to the tip 136. Additionally, the tail 128 comprises a peripheral bead 150 along the upper edge first portion 132 and the tip 136 to strengthen the tail 128.

Figure 12:
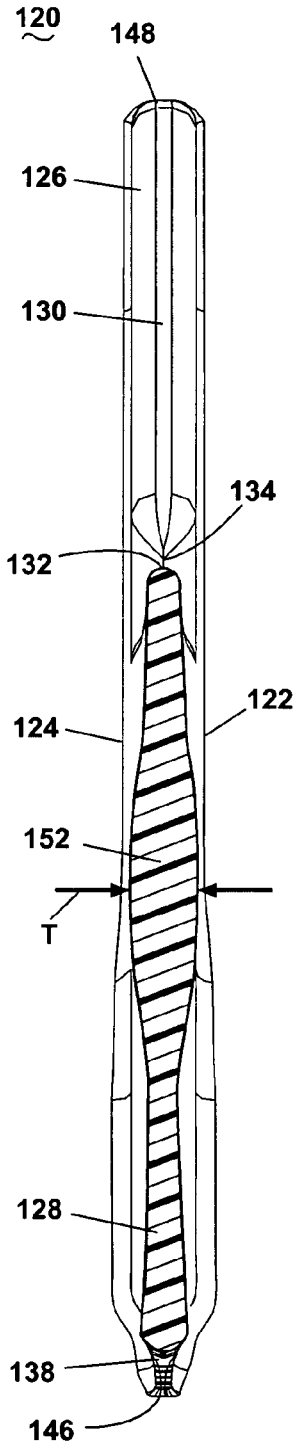
FIG. 12 is a sectional view taken along line 12-12 of FIG. 11.
Figure 13:
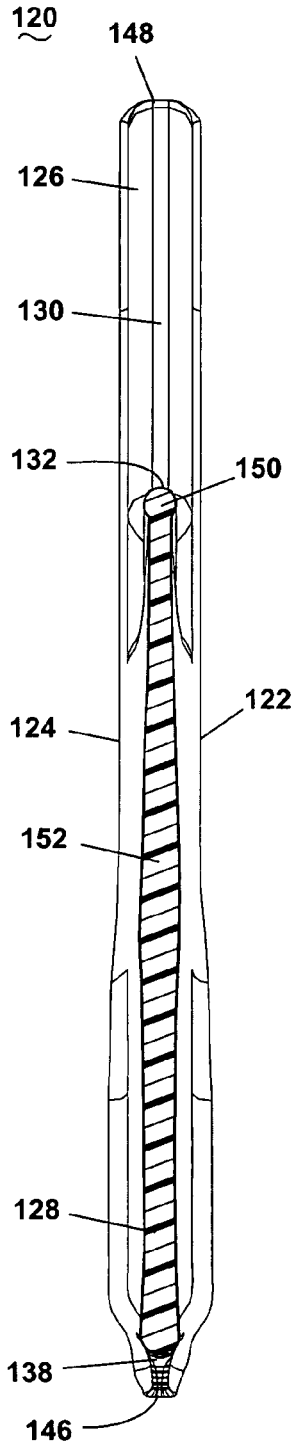
FIG. 13 is a sectional view taken along line 13-13 of FIG. 11.
Figure 14:
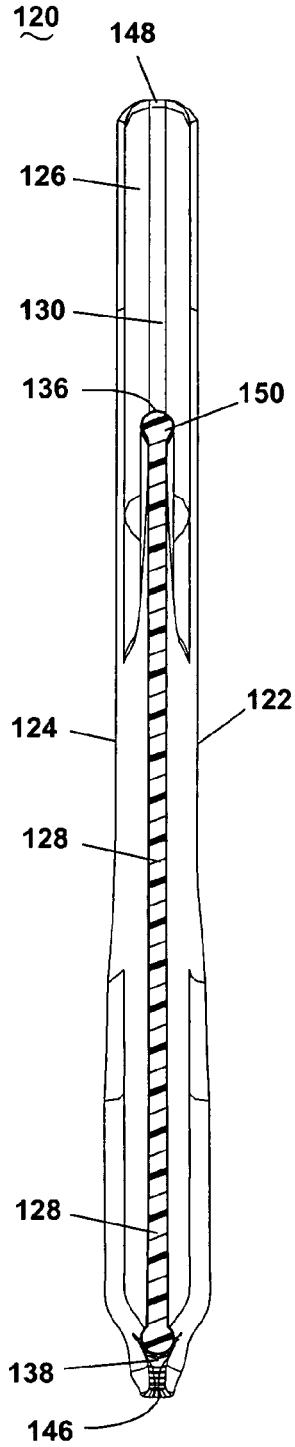
FIG. 14 is a sectional view taken along line 14-14 of FIG. 11.

As seen in FIGS. 12-14, the tail 128 of the agitator vane 120 comprises a variable thickness T, which is the distance from the right face 122 to the left face 124. In general, the tail 128 comprises a generally triangular central region 152, as shown in FIG. 11, wherein the thickness T is noticeably larger than the thickness T of the rest of the tail 128. To form the central region 152, the thickness T increases from the tip 136 to near the base 126, from the upper edge second portion 132 to the center of the tail 128, and from the bottom edge 138 to the center of the tail 128. However, this description is very general, and the thickness T of the tail 128 can include deviations from this general pattern. For example, in FIG. 12, which is a sectional view of the tail 128 at a location near the base 126, the thickness T initially actually decreases from the bottom edge 138 towards an area below the central region 152 before it increases at the central region 152. The central region 152 strengthens the tail 128 to achieve a desired mechanical behavior of the tail 128 during a wash cycle, and the actual shape of the central region 152 can alter from that shown in the figures and can be optimized depending on the overall shape of the tail 128.

The agitator vane 120 is preferably integral with the skirt 96 and connected to the skirt 96 from the upper connection point 148 to the lower connection point 146, as best viewed in FIG. 10. Specifically, the rear edge first portion 140 joins with the inner perimeter ring 92 and the skirt 96, and the rear edge corner 144 and the rear edge second portion 142 join with the corner 108 of the depression 102. The bottom edge 138 is spaced from the bottom wall 110 of the depression so that the tail 128 is movable within the depression 102 and relative to the bottom wall 110.

As shown in FIG. 10, the agitator vanes 120 are composed of a material that is different than the material for the agitator barrel 80 and the skirt portion 90. In particular, the agitator vanes 120 are made from a material is that substantially more flexible than the material for the agitator barrel 80 and the skirt portion 90. In other words, the flexural modulus for the agitator vane material is significantly less than that of the agitator barrel and skirt portion material. The flexural modulus is a measure of flexibility and is defined as the ratio of an applied flexural stress to the strain resulting from the applied flexural stress. As the flexural stress required to obtain a given strain increases, the flexural modulus increases, and the resistance to flexing increases. Conversely, as the strain that results from a given amount of flexural stress decreases, the flexural modulus increases. Preferably, the agitator barrel 80 and the skirt portion 90 are made of polypropylene while the agitator vanes 120 are composed of an elastomer, such as Santoprene® Rubber. Santoprene is commercially available in several grades, and, while any suitable grade of Santoprene can be utilized, the preferred grade of Santoprene is 203-50. The flexural moduli of Santoprene 203-50 and of polypropylene at room temperature are 347 psi and 180,000 psi, respectively. Preferably, the entire vane 120 is made of the more flexible material, but it is within the scope of the invention for only portions of the vane 120, such as the tail 128, to be made of the more flexible material. Additionally, the fins 112 can be constructed of either the same material as the agitator barrel 80 and the skirt portion 90, the same material as the agitator vanes 120, or another material.

Figure 8A:
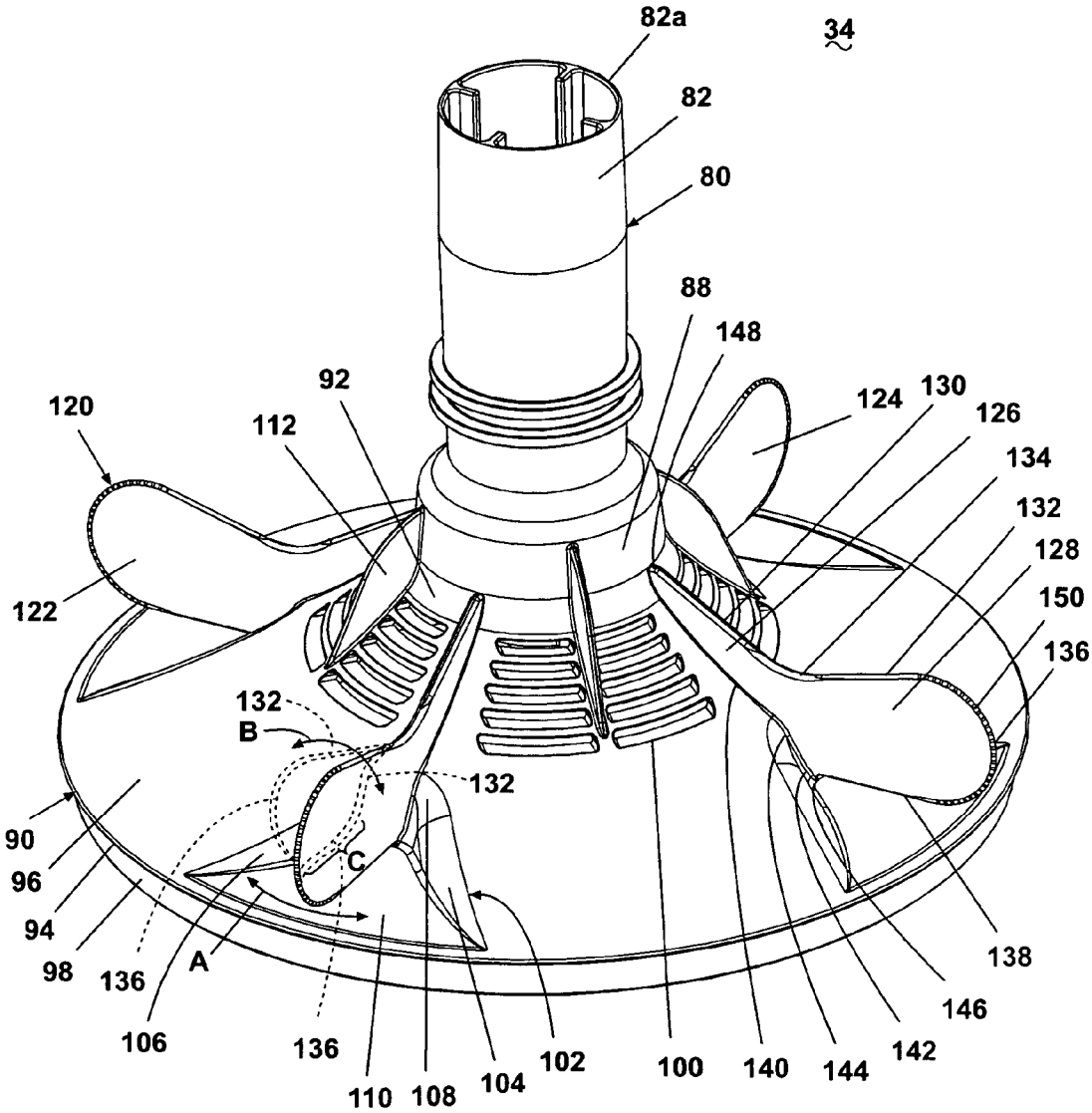
FIG. 8A is identical to FIG. 8 except that it illustrates flexing of a vane for the agitator, with flexed positions of the vane shown in phantom.
Figure 8B:
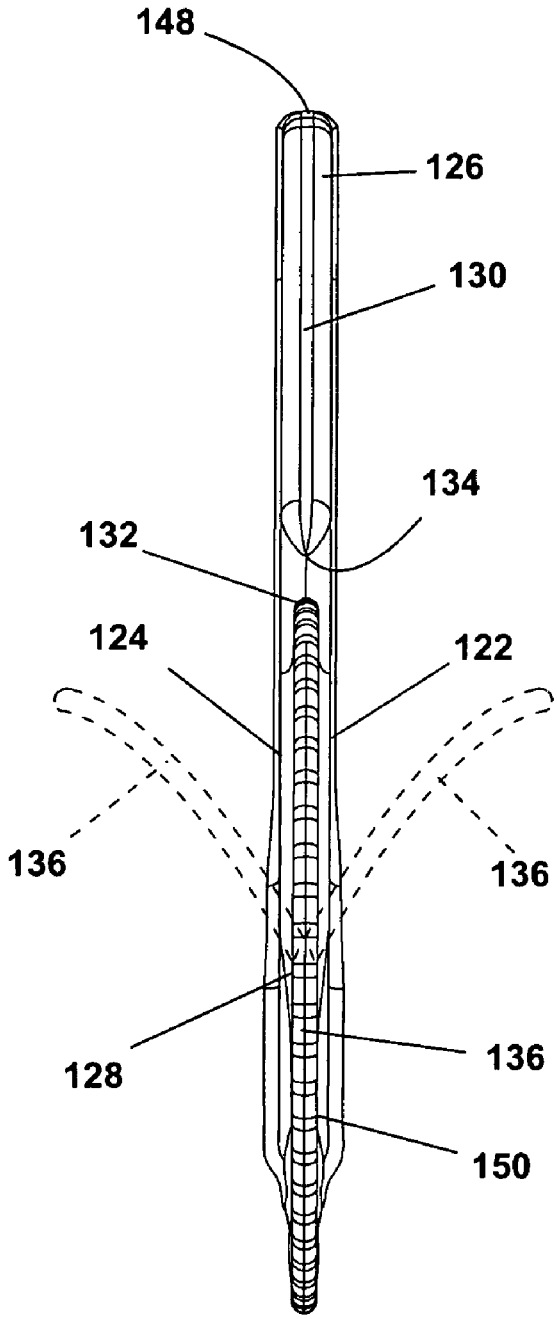
FIG. 8B is an end view of the vane of FIG. 8A with the flexed positions of a portion of the vane shown in phantom.

The combination of the shape of the agitator vane 120, the variable thickness of the tail 128, and, primarily, the material of the agitator vane 120 enables the agitator vane 120 to flex in multiple directions and about multiple axes, and, as a result, the agitator vane 120, unlike the prior art agitators, applies an upward force directly to the clothing in addition to an outward force as the agitator 34 moves the clothing from the auger 32 to the peripheral wall 22*b* of the basket 22. The flexed positions of the tail 128 are shown in phantom lines in FIGS. 8A and 8B. In FIG. 8B, the phantom lines represent the flexed positions of the portion of the tip 136 labeled C in FIG. 8A. The tail 128 can pivot about an axis coincident with the lower connection point 146 and the upper edge corner 134 or other similarly oriented axes to move from side-to-side (as shown by arrow A of FIG. 8A) between the right and left walls 104, 106 of the depression 102. Additionally, the tail 128 can flex (as shown by arrow B of FIG. 8A) from a generally vertical position about an axis coincident with the corner 144 and the tip 136 and parallel to the upper edge second portion 132 or other similarly oriented axes such that the upper edge second portion 132 and a portion of the tip 136 bend towards the right and left walls 104, 106 so that the portions of the left and right faces 124, 122, respectively, near the upper edge second portion 132 and the tip 136 face upward and away from the bottom wall 110 of the depression 102. For example, when the agitator 34 rotates clockwise, the tail 128 pivots towards the right wall 104 of the depression 102 and flexes such that a portion of the left face 124 faces upwards and away from the bottom wall 110. When the clothing contacts the portion of the left face 124 that faces upwardly, the agitator vane 120 forces the clothing to move upwards along the peripheral wall 22*b* of the basket 22. When the agitator 34 rotates counterclockwise, the tail 128 pivots towards the left wall 106 of the depression 102 and flexes such that a portion of the right face 122 faces upwards and away from the bottom wall 110. In this case, when the clothing contacts the portion of the right face 122 that faces upwardly, the agitator vane 120 forces the clothing to move upwards along the peripheral wall 22*b* of the basket 22. The amount of upward force applied to the clothing can be altered by changing the shape of the agitator vane 120; the extent to which the tail 128 protrudes beyond the outer perimeter 94 of the skirt 96; the manner in which the agitator vane 120 joins with the skirt 96; the shape, size, and thickness of the central region 152 in the tail 128; and the material of the agitator vane 120. Unlike prior art agitator vanes, the tail 128 of the agitator vane 120 can extend beyond the outer perimeter 94 of the skirt portion 96 and even up to the peripheral wall 22*a* of the basket 22, if desired, because the agitator vanes 120 help push the clothing upward and outward rather than solely pushing the clothes radially outward.

It should be understood that while for ease of description the flexing of the vane along the directions of arrows A and B are described independently, the two types of flexing can and will occur simultaneously and form a compound flexing during the operation of the agitator.

Figure 15:
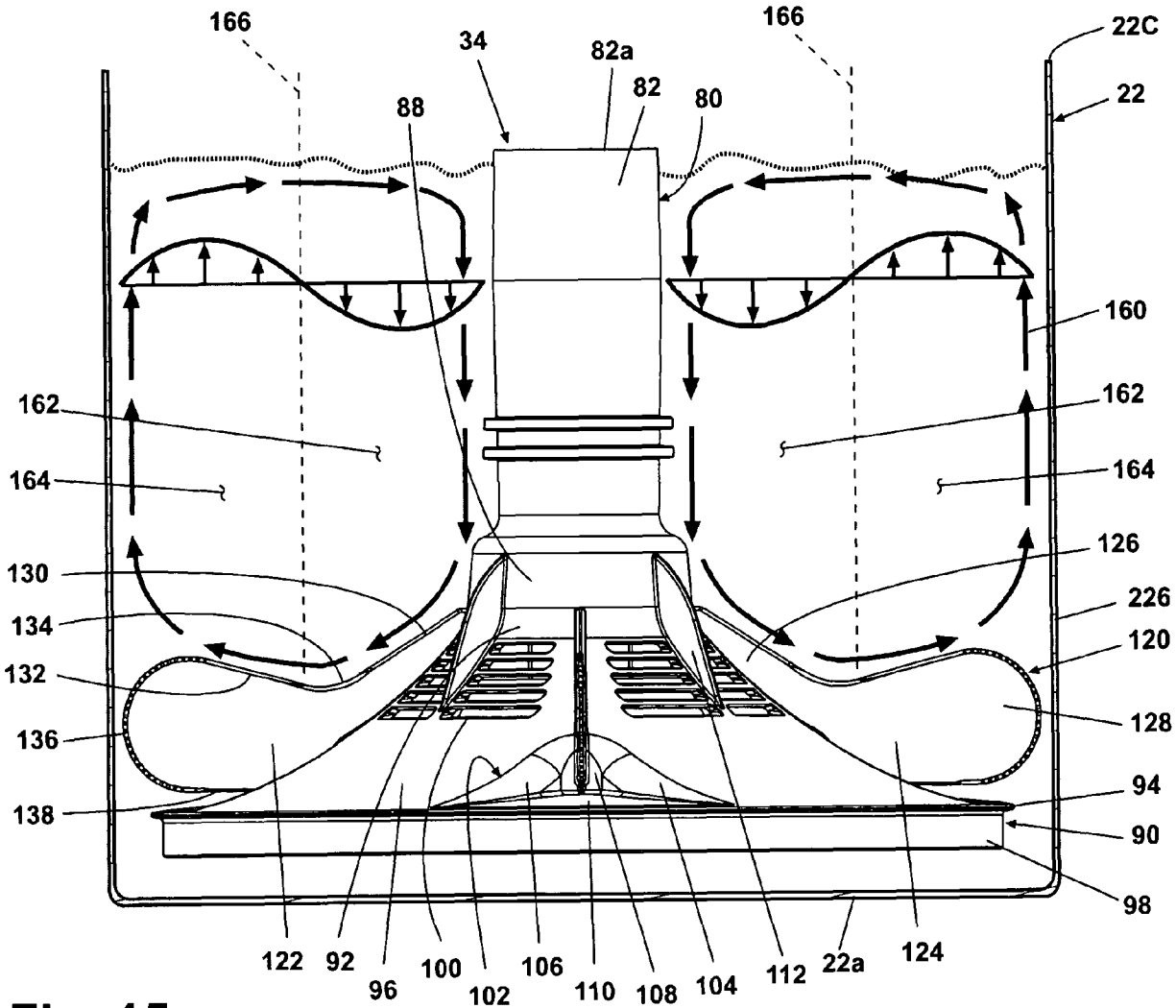
FIG. 15 is a schematic view of the agitator shown in FIG. 8 inside a basket of a washing machine and showing a toroidal path for a clothes load during a wash cycle.

FIG. 15 schematically illustrates the toroidal path of the clothing between the agitator 34 and the basket 22 and the importance of the shape of the agitator vane 120. As indicated by arrows 160, the clothing and wash liquid moves downward along the agitator barrel 80, outward and upward along the skirt portion 90, upward along the peripheral wall 22*b* of the basket 22 to the surface of the wash liquid, and inward towards the agitator barrel 80. As a result, the space between the agitator barrel 80 and the basket 22 comprises two regions: an inner region 162 where the clothing and wash liquid move generally downward and an outer region 164 where the clothing and wash liquid move generally upward. The inner and outer regions 162, 164 are separated by a boundary 166 schematically indicated by phantom lines in FIG. 15. As explained previously, the upper edge second portion 132 and a portion of the tip 136 can flex and bend to impart upward motion to the clothing. Hence, this region of the tail 128, which begins about where the upper edge corner 134 meets the upper edge second portion 132, is positioned entirely within the outer region 164. Furthermore, the upper edge corner 134 strategically coincides with the border 166 so that the clothing begins to gradually move upward as soon as it enters the outer region 164.

Because the agitator 34 moves the clothing upward in addition to outward, the washing machine 10 is more effective and more efficient than washing machines having prior art agitators that only move the clothing outward. For example, the upward movement of the clothing prevents clothing from collecting at the bottom of the basket 22 and helps the move clothing along the toroidal path to improve the cleaning performance. Additionally, the mechanical energy requirements of the agitator 34 are reduced, which corresponds to lower electrical energy consumption, lower maximum motor torque, and lower motor temperature.

As indicated above, the performance of the agitator 34 depends on several factors, and a primary factor is the agitator vane material. Performance tests involving agitators 34 having agitator vanes 90 constructed of materials with differing flexural moduli yielded the results listed in Table I. Table I includes the following performance parameters:

Electrical Energy=average consumption of electrical energy during agitation

Mechanical Energy=average mechanical energy applied to the clothing by the agitator during agitation Effectivness=Mechanical Energy/Electrical Energy Motor Temperature=average temperature increase of the motor during agitation Maximum Speed=maximum rotational speed of the agitator during agitation Maximum Torque=maximum torque of the motor during agitation Cycle Time=average time of a full reciprocating agitation cycle

TABLE I

Agitator Performance for Various Agitator Vane Materials

| Agitator Vane Material | Santoprene 101-55 | Santoprene 203-50 | Polypropylene |
|---|---|---|---|
| (Flexural Modulus (psi)) | (7.8) | (347) | (180,000) |
| Electrical Energy (W) | 294 | 305 | 368 |
| Mechanical Energy (W) | 124 | 125 | 131 |
| Effectiveness (W/W) | 0.42 | 0.41 | 0.36 |
| Motor Temperature (° C./min) | 3.65 | 4.41 | 6.21 |
| Maximum Speed (RPM) | 152 | 156 | 131 |
| Maximum Torque (Nm) | 24.7 | 25.3 | 28.2 |
| Cycle Time (sec) | 1.21 | 1.21 | 1.17 |

When the agitator vanes 120 are made of Santoprene 203-50 compared to polypropylene, the motor that drives the agitator 34 consumes less electrical energy, and the conversion of the electrical energy into mechanical energy applied to the clothing is more efficient. Further, the increase in the motor temperature and the maximum torque of the motor are both significantly reduced. Consequently, the agitator 34 with the Santoprene 203-50 agitator vanes 120 is more energy efficient and less demanding on the motor compared to the agitator 34 with the polypropylene agitator vanes 120. Further improvements can be achieved with Santoprene 101-55; however, the Santoprene 101-55 is extremely flexible and not preferred for use in the agitator vanes 120. The agitator vanes 120 must be strong enough to at least partially support the weight of the clothing as it moves across the agitator 34.

When the agitator assembly 30 is assembled, the agitator barrel 80 is disposed within the lower portion 44 of the auger body 40, and the lower end 44*a* of the auger body 40 abuts the intermediate ring 88 of the auger 32. As discussed previously, the agitator 34 couples to the motorized drive mechanism through the drive connection 86, and the auger 32 couples with the agitator 34 through the drive mechanism.

During operation of the agitator assembly 30, the motorized drive mechanism reciprocally rotates the agitator 34 clockwise and counterclockwise, and the auger 32 rotates with the agitator 34 in one of the directions and is stationary while the agitator 34 rotates in the other direction. As the agitator assembly 30 rotates, the auger 32 moves the clothes downward from the surface of the wash liquid towards the agitator 34, and the agitator fins 112 move the clothing radially outward while the agitator vanes 120 move the clothing radially outward and upward along the peripheral wall 22*a* of the basket 22. The clothing continues along the toroidal path towards the surface of the wash liquid and back to the auger 32.

Although the agitator assembly 30 has been shown and described as comprising the auger 32 and the agitator 34, it will be apparent to one of skill in the washing machine art that the agitator 34 can be used without the auger 32 or with a different auger. Similarly, the auger 32 can be utilized in combination with an agitator other than the agitator 34 described herein or other clothes and/or wash liquid mover, such as an impeller or a nutator. Furthermore, the agitator vanes 120 have been described thus far as being integral with the skirt portion 90. However, it is within the scope of the invention for the agitator vanes 120 to be separate from the skirt portion 90 and attached thereto with, for example, mechanical fasteners, adhesives, or joining processes, such as heat staking. Additionally, the vanes 120 can be incorporated into another type of clothes mover other than an agitator, such as an impeller or nutator.

Figure 16:
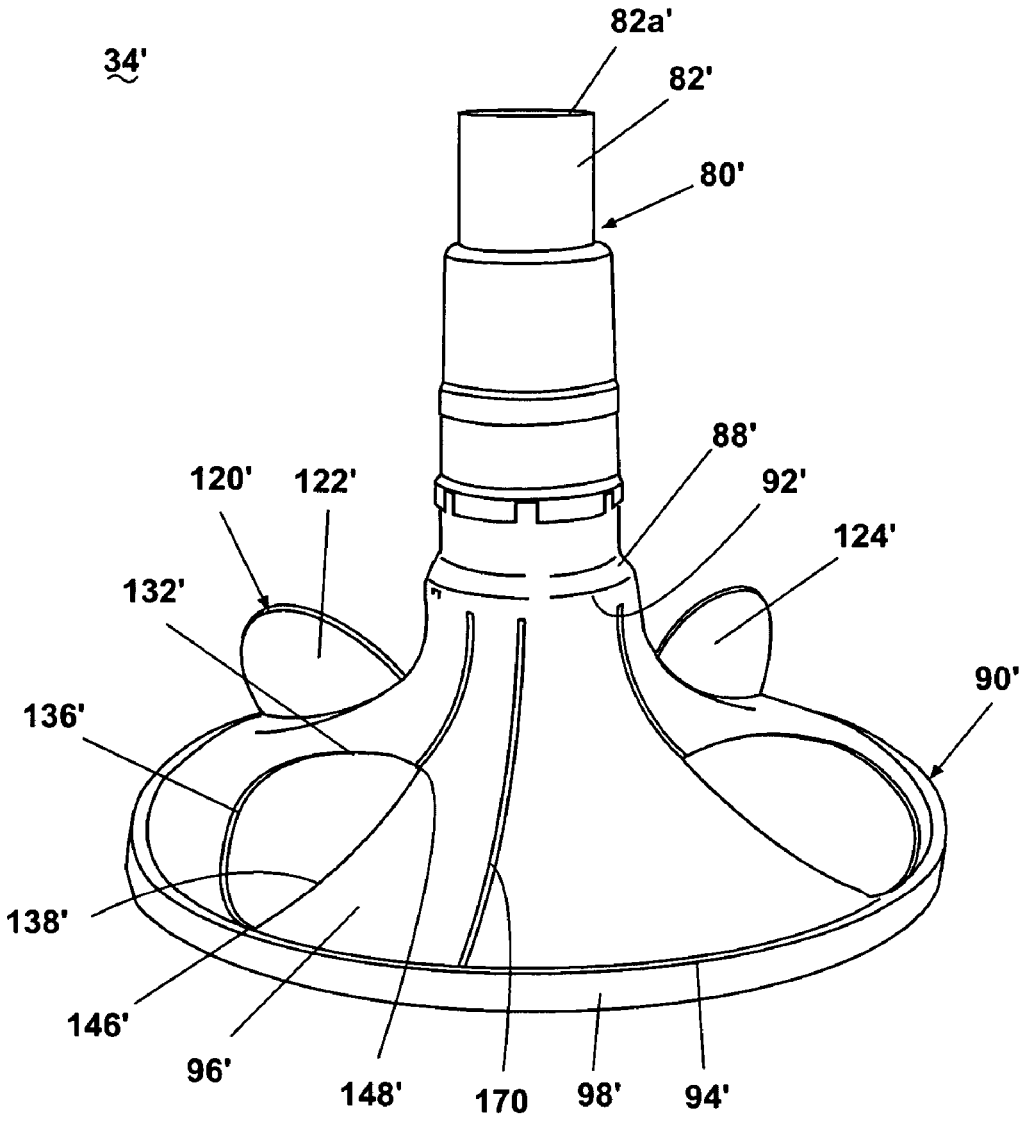
FIG. 16 is a perspective view of a second embodiment of an agitator according to the invention.

A second embodiment agitator 34' is illustrated in FIG. 16, where like elements are identified with the same reference numeral bearing a prime symbol (′). The second embodiment agitator 34' is similar to the first embodiment agitator 34, and the primary differences relate to the skirt 96' and the agitator vanes 120'. The skirt 96' flares radially outward from the inner perimeter 92' to the outer perimeter 94' and comprises several spaced radial slots 170 that receive the agitator vanes 120'. As in the first embodiment, the agitator vanes 120' comprise a right face 122' and a left face 124', but the shape of the agitator vanes 120' is defined by an upper edge 132', an outer edge or tip 136', and a bottom edge 138'. The bottom edge 138' resides within the slot 170 and abuts the outer perimeter 94' at a lower connection point 146'. The upper edge 132' joins the bottom edge 138' at an upper connection point 148', which is located about midway between the inner perimeter 92' and the outer perimeter 94'. Because the agitator vanes 120' are composed of a relatively flexible material and are joined to the skirt 96' along the bottom edge 138', the agitator vanes 120' can flex such that at least a portion of either the right face 122' or the left face 124' faces away from the skirt 96' to impart an upward force to the clothing.

Figure 17:
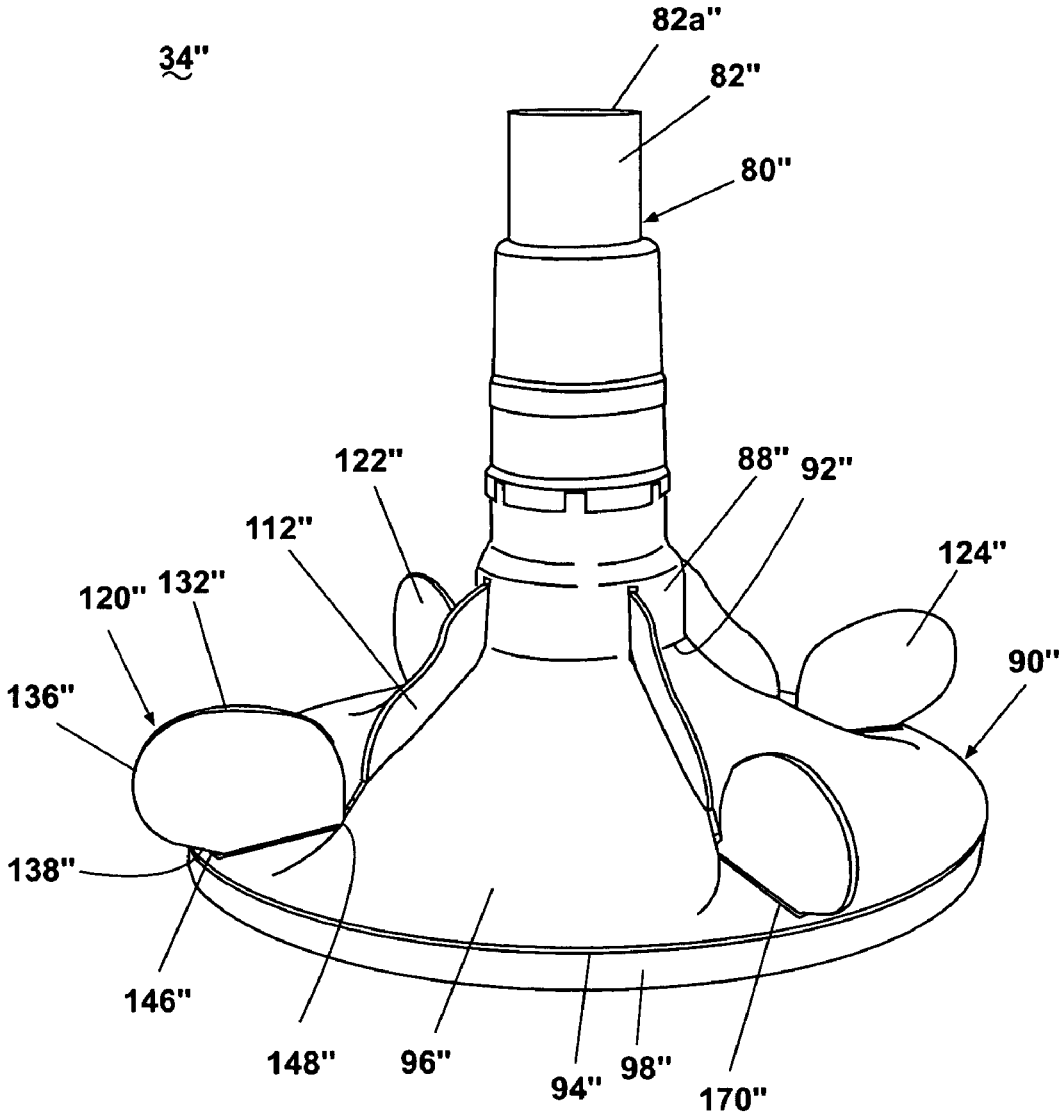
FIG. 17 is a perspective view of a third embodiment of an agitator according to the invention.

A third embodiment agitator 34" is shown in FIG. 17, where like elements are identified with the same reference numeral bearing a double prime (") symbol. The third embodiment agitator 34" is substantially identical to the second embodiment agitator 34', except that the former comprises fins 112" that extend radially from the intermediate ring 88" to about midway between the inner perimeter 92" to the outer perimeter 94". Additionally, the agitator vanes 120" further comprise a rear edge 140" between the upper edge 132" and the bottom edge 138", and the lower connection point 146" is located where the rear edge 140" and the bottom edge 138" meet. Further, the tip 136" projects farther beyond the outer perimeter 140" than in the second embodiment. As with the second embodiment, the agitator vanes 120" join with the skirt 96" along the bottom edge 138" and can flex as previously described to impart upward and outward motion to the clothing.

While the invention has been specifically described in connection with certain specific embodiments thereof, it is to be understood that this is by way of illustration and not of limitation, and the scope of the appended claims should be construed as broadly as the prior art will permit.

What is claimed is:

1. A washing machine comprising:

a basket defining a wash chamber; and a clothes mover mounted in the wash chamber and comprising:

a body mounted for reciprocal rotational movement about a generally vertical axis; and at least one vane comprising:

a base mounted to the body; and a tail extending from the base, comprising:

an upper edge extending from the base and separated from the body;

a lower edge extending from the base and separated from the body;

a tip extending between the upper and lower edges and defining an outer extent of the tail; and a strengthening region extending generally radially from the body and in a direction from the base toward the tip;

wherein in response to the rotation of the body within liquid, a portion of the tail above the strengthening region undergoes compound flexing where the portion of the tail imparts both a radially outward force and a vertical force on the surrounding liquid, the compound flexing being a combination of a side-to-side flexing of the tail enabled by the upper and lower edges being separated from the body and a vertical flexing enabled by the portion of the tail above the strengthening region flexing down and up in an overall vertical movement.

2. The washing machine according to claim 1, wherein the strengthening region is thicker than the rest of the tail.

3. The washing machine according to claim 2 wherein the strengthening region is spaced from the upper and lower edges.

4. The washing machine according to claim 2 wherein the strengthening region has a variable thickness.

5. The washing machine according to claim 4, wherein the thickness of the strengthening region increases toward the base.

6. The washing machine according to claim 1, wherein a height of the tail increases from the base of the at least one vane to the tip of the tail.

7. The washing machine according to claim 1, wherein the tip extends radially beyond the body.

8. The washing machine according to claim 1, wherein the body comprises a depression that at least partially receives the tail and accommodates the side-to-side flexing of the tail.

9. The washing machine according to claim 1, wherein the body is made of a first material, and at least the tail of the at least one vane is made of a second material different from the first material.

10. The washing machine according to claim 9, wherein the entire vane is made of the second material.

11. The washing machine according to claim 9, wherein the second material is more flexible than the first material.

12. The washing machine according to claim 9, wherein the second material comprises an elastomer.

13. The washing machine according to claim 12, wherein the first material comprises polypropylene.

14. The washing machine according to claim 9, wherein the at least one vane is integrally molded with the body.

15. The washing machine according to claim 1, wherein the clothes mover is an agitator.

16. The washing machine according to claim 1, wherein the clothes mover comprises a plurality of the vanes.

17. The washing machine according to claim 16, wherein the plurality of the vanes are equally spaced.

18. The washing machine according to claim 16, wherein the vanes are oriented radially relative to the vertical axis.

19. The washing machine according to claim 1 wherein the side-to-side flexing occurs about a first axis generally parallel to the body axis of rotation.

20. The washing machine according to claim 19 wherein the vertical flexing occurs about a second axis generally perpendicular to the first axis.

21. The washing machine according to claim 1 wherein the strengthening region is spaced from the upper and lower edges by regions having a thickness less than that of the strengthening region.

22. The washing machine according to claim 1 wherein the strengthening region is generally triangular.

23. A washing machine comprising:

a basket defining a wash chamber; and an agitator located in the wash chamber and comprising:

a body made of a first material; and at least one vane mounted to the body made of a second material different from the first material, the vane comprising:

upper and lower edges separated from the body;

a tip extending between the upper and lower edges and defining an outer extent of the vane; and a strengthening region extending generally radially from the body and in a direction generally along a longitudinal axis of the vane;

wherein a portion of the vane above the strengthening region is configured for compound flexing in differing first and second directions such that in response to the rotation of the body within liquid, the portion of the vane imparts both a radially outward force and a vertical force on the surrounding liquid, the compound flexing being a combination of a side-to-side flexing of the vane enabled by the upper and lower edges being separated from the body and a vertical flexing enabled by the portion of the vane above the strengthening region flexing down and up in an overall vertical movement.

24. The washing machine according to claim 23, wherein a flexural modulus of the second material is greater than a flexural modulus of the first material.

25. The washing machine according to claim 24, wherein the second material comprises an elastomer.

26. The washing machine according to claim 25, wherein the first material comprises polypropylene.

27. The washing machine according to claim 23, wherein the at least one vane is integrally molded with the body.

28. The washing machine according to claim 23, wherein the at least one vane extends radially beyond the body.

29. The washing machine according to claim 23, wherein the agitator comprises a plurality of the vanes.

30. The washing machine according to claim 29, wherein the plurality of the vanes are equally spaced.

31. The washing machine according to claim 29, wherein the vanes are oriented radially relative to the vertical axis.

32. The washing machine according to claim 23 wherein the side-to-side flexing occurs about a first axis generally parallel to the body axis of rotation.

33. The washing machine according to claim 32 wherein the vertical flexing occurs about a second axis generally perpendicular to the first axis.

34. The washing machine according to claim 23 wherein the strengthening region is thicker than the rest of vane.

35. The washing machine according to claim 34 wherein the strengthening region is spaced from the upper and lower edges.

36. The washing machine according to claim 34 wherein the strengthening region has a variable thickness.

37. The washing machine according to claim 23 wherein the strengthening region is spaced from the upper and lower edges by regions having a thickness less than that of the strengthening region.

38. The washing machine according to claim 23 wherein the strengthening region is generally triangular.

* * * * *